US005569915A

United States Patent [19]

Purser et al.

[11] Patent Number: 5,569,915

[45] Date of Patent: Oct. 29, 1996

[54] SENSITIVE MASS SPECTROSCOPY USING MOLECULAR FRAGMENTATION

[76] Inventors: Kenneth H. Purser, 360 N. Emerson Rd., Lexington, Mass. 02173; Linas R. Kilius, 30 Rosemount Avenue, Thornhill, Ontario, Canada, L3T-6S7; Albert E. Litherland, 3 Hawthorne Gardens, Toronto, Canada, M4W 1P4; John C. Rucklidge, 351 Wellesley Street East, Toronto, Ontario, Canada, MA4X1H2; Xiaolei Zhao, 10B Henry St., Toronto, Ontario, Canada, M5T 1X1

[21] Appl. No.: 422,520

[22] Filed: Apr. 14, 1995

[51] Int. Cl.[6] ..... H01J 49/26

[52] U.S. Cl. ..... 250/281; 250/282

[58] Field of Search ..... 250/281, 282, 250/296, 294, 297; 976/DIG. 437

[56] References Cited

U.S. PATENT DOCUMENTS 4,037,100 7/1977 Purser ..... 250/281

4,536,652 8/1985 Cooks et al. ..... 250/281

5,237,174 8/1993 Purser ..... 250/281

5,438,194 8/1995 Koudijs et al. ..... 250/288 A

*Primary Examiner*—Jack I. Berman

*Assistant Examiner*—Kiet T. Nguyen

*Attorney, Agent, or Firm*—Nields & Lemack

[57] ABSTRACT

A highly sensitive spectrometer system having inherently low backgrounds is described. In this new molecular accelerator mass spectrometry procedure, negative molecules containing the isotope of interest are accelerated using a tandem accelerator. Subsequent electron stripping and analysis stages outside of the accelerator fragment the molecules and eliminate mass upon charge ambiguities. The combination results in a cost effective accelerator mass spectrometer with high sensitivity and low backgrounds.

11 Claims, 1 Drawing Sheet

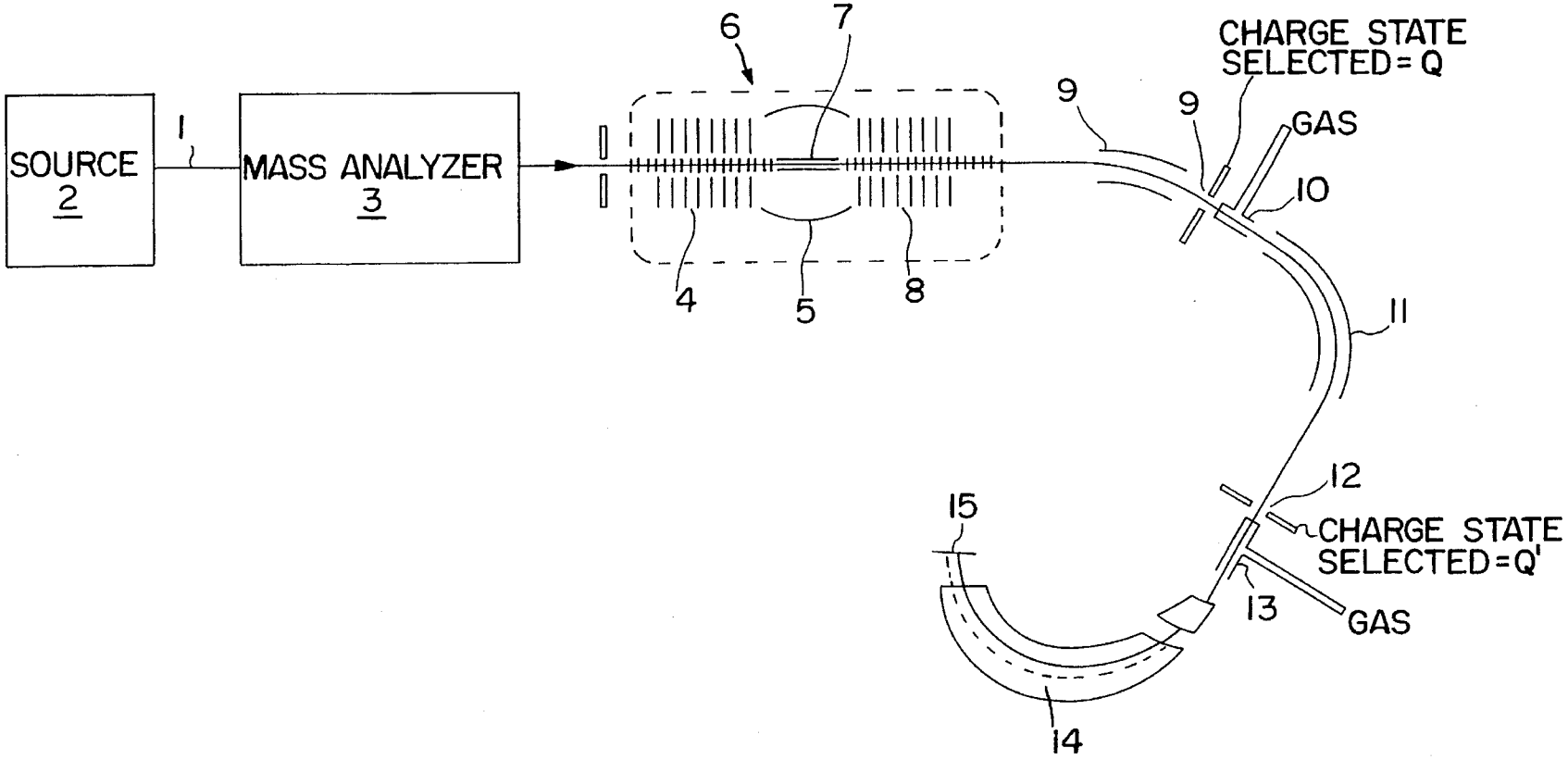
SOURCE
2
1
MASS ANALYZER
3
6
7
8
5
4
9
9
CHARGE STATE
SELECTED=Q
GAS
10
11
12
CHARGE STATE
SELECTED=Q'
GAS
13
14
15

SENSITIVE MASS SPECTROSCOPY USING MOLECULAR FRAGMENTATION

THE BACKGROUND OF THE INVENTION

1. Field of the Invention

This invention relates to the detection of rare atomic species and the measurement of isotopic ratios with minimal backgrounds that are free from molecular interferences using accelerator mass spectrometry. Although limitations in scope are not intended, this invention has particular relevance to the fields of isotopic ratio measurements in geology, oceanography and nuclear weapons proliferation monitoring.

2. Description of Prior Art

During the last fifteen years, the sensitivity for detecting isotopes has been enhanced by many orders of magnitude using Tandem Accelerator Mass Spectrometry (AIMS). Descriptions of the technique include, for example, U.S. Pat. No. 4,037,100 to K. H. Purser and an article by D. Elmore and F. M. Phillips, "Accelerator Mass Spectrometry" in *Science,* Volume 236, p543 (1987). In the teachings of Purser described in the above U.S. Pat. No. 4,037,100, the atomic mass to be detected is accelerated as a negative ion beam and the charge exchange needed to fragment associated molecules takes place before the second acceleration stage. Thus, because the charge state tends to be high to guarantee fragmentations, the energy of the ions is increased considerably following fragmentation and before final analysis. Furthermore, to efficiently convert ions into the necessary high charge state, the tandem terminal voltage must be high leading to further increases in energy. The effect of this is that unnecessarily large systems are needed both for tandem acceleration and for the subsequent analyzers, with a corresponding increase in cost. While in a limited number of cases the extra energy is useful for isobar discrimination, heavy isobar pairs cannot be distinguished by energy loss or range measurements at realistic energies so that in many cases, the extra energy is a disadvantage rather than a gain. A second disadvantage is that not all molecular ambiguities are eliminated during a single fragmentation collision. Fragments having similar ratios of mass upon charge (M/q) and energy upon charge (E/q) will be transmitted without attenuation through all medium resolution electric deflection, magnetic deflection, crossed field and high frequency analyzers.

It is also the case that there are many examples where it is difficult to produce negative atomic ions of the wanted species. Thus, negative molecular ions that contain the atomic species of interest is often a convenient way of producing the particles needed for tandem acceleration. Negative ion oxides of beryllium, boron, aluminum, iron, and tantalum are therefore commonly used whenever these elements are to be analyzed. In some cases, such as nitrogen or magnesium, which do not form atomic negative ions, molecular ions are the only alternative. In practice, it may be desirable to use fluoride molecules for accelerating wanted elements. Fluorides are particularly useful molecules as fluorine is monoisotopic which reduces the number of isotopic mass combinations. It is known that uranium hexafluoride has a negative ion affinity of 5.6 electron volts which exceeds most atomic species by a factor of 2.

Furthermore, an important point to note is that the energy spectrum from sputtered molecular ions is significantly different from that of atomic ions. The high energy tags which are present in atomic ion spectra are reduced by approximately four orders of magnitude in the case of molecular ions. The presence of the above tail in an atomic ion spectrum creates difficulties whenever the mass of interest is greater than that of the more abundant isotope so that the use of molecules may be of great advantage.

3. Present Invention

The present invention comprehends an economical apparatus that carries out the task of efficiently determining isotopic ratios and elemental abundances when the concentration of the wanted elements are in the range of parts per billion to parts per trillion. The method to be described is generally applicable to a variety of sample compositions and to most elements in the periodic table. An important feature is that the primary ions from the source are not necessarily atomic species and when necessary can be molecules that include the isotopes of interest.

In the present invention, the concept of a tandem accelerator being used as a molecular fragmenter within its high voltage terminal as described in U.S. Pat. No. 4,037,100, has changed from that of a molecular disintegrator to that of a simple molecular accelerator. In this mode of operation, the necessary fragmentation to produce the wanted atomic mass is carried out by electron stripping using a foil or high pressure gas region at ground.

It is known that the majority of charge state $1^+$ molecular ions are stable and can be created by the removal of two electrons from the corresponding negative molecular ion. At the optimal terminal voltages used in this type of apparatus (1–3 million volts), the dominant charge state during terminal stripping will be $1^+$, $2^+$ and $3^+$. Yields of ions leaving the tandem in either $1^+$ or $2^+$ charge state can be dose to 50%, particularly if the stripper gas thickness is kept below equilibrium. Non-equilibrium production of charge state $1^+$ and $2^+$ molecular ions also assists in the subsequent analysis as energy losses due to straggling are reduced at the lower gas pressures. Using a small stripper thickness also reduces the small angle scattering which can be serious for heavy mass ions.

4. Discussion of Mass Ambiguities

Referring to FIG. 1, the energy, E, of atomic ions arriving at the tandem output, 15, is given by:

$$E=(Q+1).V_T$$

Here,

Q is the charge state $V_T$ is the terminal potential of the tandem accelerator

For molecules, the energy, $E_m$, of a molecular fragment or atomic ambiguity having mass, m, is given by:

$$E_m=(Q+m/M).V_T$$

To separate ions from these background particles on the basis of electrostatic deflection, the necessary resolution of an electrostatic deflector can be easily shown to be:

$$R_{el}=\{[(Q+1)/Q]\times qM\}\times 1/n$$

where n=[(Mq/Q)−m]

Clearly, when Mq/Q=m, (n=0) the resolution, $R_{el}$, needed to separate the molecular fragment of mass, m, and charge, q, from the wanted ions (M,Q) becomes infinite and those ions having mass, m, will be transmitted without attenuation to the detector. Clearly, ambiguities will be present whenever M/Q=m/q or when n is a small number 1, 2, 3, etc. These approximate m/q ambiguities are therefore of great importance especially in view of the Coulomb explosion which often occurs during the molecular fragmentation process adding substantial energy spreads to the beam in the laboratory frame of reference.

5. Second Charge Exchange

The above m/q ambiguities can be completely eliminated by a further charge exchange where the ions having the originally selected charge state, Q, are charge changed to a new charge state, Q', where Q' is not a multiple or submultiple of Q. For example, if Q is selected to be $3^+$, Q' might be $4^+$ or $5^+$. q which in the above example was $2^+$ or $1^+$ cannot take non-integral values and so the original m/q ambiguity particles can be eliminated by a following analysis stage with quite modest resolution.

Not only does the above change in charge state dramatically reduce the analyzer resolution needed, because the charge state is usually increased, the necessary electric and magnetic deflection capacity of succeeding analyzers is reduced.

6. Application

As an example of the use of such a charge exchange sequence, consider the detection of the long-lived radioisotope $^{129}I$. Using conventional AMS practice, it is necessary to accelerate $^{129}I$ in the $5^+$ charge state. The reason for this is that $^{129}I^{3+}$ cannot be used because of the m/M ambiguity from $^{86}Sr^{2+}$ and $^{43}Ca^{1+}$. The $^{129}I^{4+}$ cannot be used because of $^{97}Mo^{3+}$.

However, using $^{129}I^{3+}$ from the tandem allows the conversion efficiency at the high voltage terminal to increase by a factor 8.1 for $V_T$=1.05 MV and 4.45 for $V_T$=2.95 MV. Due to the second charge change, a loss of efficiency is encountered which, because it is at equilibrium, is about a factor of one quarter in both cases, (although this can be improved because the charge change can be non-equilibrium). Overall, however, the transmission efficiency through the spectrometer is comparable for the classical AMS sequence and the mode of operation described here. The advantage is greatly reduced requirements for magnetic and electric analyzers reduces the cost and space needed.

A second example is that when ratios of fairly rare isotopes and m/q ambiguities from intense components such as meteoritic background or silicon wafers are encountered, the elimination of these ambiguities is critical. For example, iron isotope ratios in silicon $^{54}Fe^{+3}$ will not be measured easily because of $^{18}O^{1+}$ and $^{19}F^{1+}$, $^{38}A^{2+}$, $^{56}Fe^{4+}$ is not practical because of $^{28}Si^{2+}$. $^{57}Fe^{+3}$ could have $^{19}F^{+1}$ or $^{38}Ar^{+2}$, etc., thus, $3^+$ and $4^+$ cannot be used for all isotopes. However, with charge changing, this situation is dramatically improved and the n=0, 1, 2, 3, etc. Interferences are eliminated.

BRIEF DESCRIPTION OF THE DRAWING

Operation of the invention may best be understood from the following detailed description and the accompanying drawing.

FIG. 1 shows schematically the principles of a broad range molecular AMS spectrometer.

DESCRIPTION OF THE PREFERRED EMBODIMENT

Referring to the drawing, therein is shown a schematic of the preferred embodiment of the present invention.

A continuous beam of molecular or atomic negative ions, (1), containing the isotope to be analyzed and other unwanted atomic and molecular ions, are produced from the ion source, (2). The above beam of ions is directed through a suitable mass filter which in the preferred embodiment consists of a combination of electric and magnetic fields, (3), which select ions having a defined E/q ratio and a defined magnetic rigidity, M/q×E/q. The above selected ions of mass M, are accelerated through the first tandem acceleration stage, (4), to the high voltage terminal, (5), of a dc tandem accelerator, (6), where they arrive with an energy that is typically in the range of 1–4 MeV. Within said terminal, the above selected ions pass through a low density gas cell, (7), where electrons are stripped from each ion converting a significant fraction of the ions from having a net negative charge to a net positive charge.

While in the preferred embodiment the gas pressure of the terminal stripper would be adjusted to maximize conversion from the negative charge state of 1− to the positive charge state of $1^+$, it will be dear to those skilled in the art that the method of the present invention can be applied to all values of positive charge states. In contrast to the teachings of Purser in the above U.S. Pat. No. 4,037,100 where the gas thickness used for the above stripping procedure is commonly chosen to be dose to equilibrium, in the preferred embodiment of the present invention, the gas pressure within the cell, (7), may be chosen to minimize the amount of fragmentation that occurs in the terminal of the tandem and maximize the yield of $1^+$ molecular ions even though this gas pressure is not sufficient to reach an equilibrium charge state distribution. As, in this case, only one electron must be removed from the neutral molecule, the greatest yield will often occur at lower stripper gas pressure than are desirable for conventional AMS. Also, using lower stripper gas pressures reduces the small angle scattering that can be serious for heavy ions.

In the preferred embodiment, the above $1^+$ ions are returned to ground potential by passage through a second acceleration stage, (8), where these $1^+$ ions arrive with an energy of $2eV_T$. (Here $V_T$ is the tandem terminal potential and e is the electronic charge.) It will be recognized by those seed in the art that the magnitude of $V_T$ is not critical and the operation of the invention will be possible over a wide range of terminal potentials.

On leaving the second acceleration section, (8), the ions are electrostatically analyzed using a suitable deflection and aperture, (9), to select those ions having an electric rigidity of $2V_T$. This electrostatic analysis eliminates: i) molecules or atoms having a charge state other than $1^+$; ii) any fragments generated within the stripper cell, (7), of the tandem accelerator; iii) particles that have charge exchanged outside of the stripper cell, (7), and; iv) background particles generated within the accelerator by microdischarges or beam interactions with the residual gas in the vacuum system.

In the preferred embodiment, the above analyzed beam of $1^+$ molecular ions is then directed through a gas or foil stripper at ground, (10), which removes further electrons from each ion. These particles are analyzed a second time by passage through a second post-acceleration electrostatic (E/q) filter, (11), where the selected charge state transmitted will be $3^+$ or higher to guarantee molecular disintegration. This electric analyzer can be designed to provide E/q resolution that is only limited by the energy spreads introduced during the molecular fragmentation process, the energy spreads that are present from the ion source and the preceding tandem acceleration process. These ions pass through the second defining aperture at ground, (12).

Following this second analysis, the ions are stripped again using a second foil or gas cell, (13), at ground. This generates a new charge state distribution. In the preferred embodiment, these ions are directed through a magnetic analyzer, (14), that selects a charge state appropriately different from the above mentioned $3^+$ that was transmitted through the second electrostatic filter, (11).

In the preferred embodiment, the resultant ions are directed into a detector (15) in the focal plane of the analyzer which provides energy discrimination. This detector may have position sensitivity so that it will be possible to measure the relative intensities of several isotopes simultaneously.

We claim:

1. A method for measuring the mass and elemental composition of a sample comprising the following steps:

ionizing the sample and extracting therefrom an ion beam of known energy;

selecting ions from said ion beam having a specific mass;

accelerating said selected ions to energies of the order of a few MeV;

directing said selected MeV ions through a first thin target whereby electrons are removed from said selected ions causing them to dissociate into positive selected ions:

analyzing said positive selected ions by directing said positive selected ions through a transverse electric field onto a first apertured member;

directing said positive selected ions that passed through the aperture in said first apertured member through a second thin target causing the charge state of said positive selected ions to be modified by electron addition or subtraction;

analyzing the resulting electron-enhanced or electron-subtracted ions by directing said electron-enhanced or electron-subtracted ions having a charge state that is a non-integral multiple of the wanted ions through a second electric field onto a second apertured member; and measuring the kinematic characteristic of the ions transmitted through an aperture in said second apertured member.

2. An ultra-sensitive spectrometer for mass and elemental analysis comprising in combination:

a source of ions;

means for selecting from said source ions having a specific mass;

means for accelerating said selected ions to energies of approximately a few MeV;

means for directing said selected MeV ions through a first thin target whereby electrons are removed from said selected ions causing them to dissociate into positive selected ions;

means for analyzing said positive selected ions comprising a first apertured member and means for producing a first electric field adapted to deflect said positive selected ions onto said first apertured member in such a manner that only those ions having a specific ratio of energy to charge pass through an aperture in said first apertured member;

means for directing said ions having said specified ratio of energy to charge through a second thin target whereby the charge state of said ions is modified by electron addition or subtraction;

means for analyzing said electron-enhanced or electron-subtracted ions comprising a second apertured member and means for producing a second electric field adapted to deflect said ions onto said second apertured member in such a manner that only those ions having a second specified ratio of energy to charge pass through an aperture in said second apertured member; and means for measuring the kinematic characteristic of the ions transmitted through the aperture in said second apertured member.

3. The spectrometer of claim 2 where the means for accelerating the selected ions to energies of a few MeV is a tandem accelerator.

4. The spectrometer of claim 2 where the first thin target is a gas cell.

5. The spectrometer of claim 2 where the first thin target is a foil.

6. The spectrometer of claim 2 where said selected ions leaving the accelerator have a positive charge state of $1^+$.

7. The spectrometer of claim 2 where the second thin target is a foil.

8. The spectrometer of claim 2 where the second thin target is a gas cell.

9. The spectrometer of claim 2 where the means for measuring the kinematic characteristics of the transmitted ions includes a magnet which deflects the ions having the second specified ratio of energy to charge into a suitable detector.

10. The spectrometer of claim 2 where the means for measuring the kinematic characteristics of the transmitted ions measures individual ion velocity.

11. A method for measuring the mass and elemental composition of a sample comprising the following steps:

ionizing the sample and extracting therefrom an ion beam of known energy;

selecting ions from said ion beam having a specific mass;

accelerating said selected ions to energies of the order of a few MeV;

directing said MeV ions through a transverse electric field onto a first apertured member so as to remove unwanted ions and to select MeV ions having a desired charge state;

directing said selected MeV ions through a thin target whereby the charge state of said selected MeV ions is modified by electron addition or subtraction;

directing those of the resulting electron-enhanced or electron-subtracted ions having a charge state that is a non-integral multiple of the charge state of the wanted ions through a second electric field onto a second apertured member; and measuring the kinematic characteristic of the ions transmitted through an aperture in said second apertured member.

* * * * *